US012213578B1

(12) United States Patent
Resa

(10) Patent No.: US 12,213,578 B1
(45) Date of Patent: Feb. 4, 2025

(54) BACKPACK FOR TOY AND PLAYMAT STORAGE AND METHOD OF USE

(71) Applicant: Mario Resa, Richland Hills, TX (US)

(72) Inventor: Mario Resa, Richland Hills, TX (US)

( * ) Notice: Subject to any disclaimer, the term of this patent is extended or adjusted under 35 U.S.C. 154(b) by 199 days.

(21) Appl. No.: 18/093,606

(22) Filed: Jan. 5, 2023

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC ..... A45C 13/02; A45C 13/1069; A45C 2007/0004; A45F 2003/003; A45F 3/04; A47D 5/006
USPC ..... 224/576
See application file for complete search history.

(56) References Cited

U.S. PATENT DOCUMENTS 6,213,268 B1 * 4/2001 Dancyger ..... A45C 13/02 190/110
6,595,604 B1 * 7/2003 Peterson ..... A45C 13/02 190/110
10,667,600 B2 * 6/2020 Ji ..... A45F 3/04
2011/0314608 A1 * 12/2011 Rovin ..... A47D 5/006 5/655
2012/0103480 A1 * 5/2012 Veleno ..... A45C 15/00 150/108
2018/0014614 A1 * 1/2018 Marshall ..... A45F 3/04

FOREIGN PATENT DOCUMENTS

KR 19990034942 U * 9/1999
KR 200475407 Y1 * 12/2014

OTHER PUBLICATIONS

KR-19990034942-U Translation, Han, Sep. 6, 1999 (Year: 1999).*
KR-200475407-Y1 Translation, 안성준, Dec. 4, 2014 (Year: 2014).*

* cited by examiner

*Primary Examiner* — Nathan J Newhouse
*Assistant Examiner* — Matthew T Theis
(74) *Attorney, Agent, or Firm* — Richard Eldredge; Leavitt Eldredge Law Firm

(57) ABSTRACT

A backpack for storing and transporting toys, objects, etc., is disclosed. The backpack includes a top compartment; a bottom compartment having a first attachment mechanism; and a removable playmat having indicia thereon and a second attachment mechanism; wherein the top and bottom compartments are separated by a closing mechanism; wherein the playmat removably attaches to the first attachment mechanism via the second attachment mechanism.

6 Claims, 11 Drawing Sheets

BACKPACK FOR TOY AND PLAYMAT STORAGE AND METHOD OF USE

BACKGROUND

1. Field of the Invention

The present invention relates generally to storage containers, and more specifically to a backpack for storing various objects and having a detachable playmat.

2. Description of Related Art

Storage containers are well known in the art for storing various objects such as children's toys, games, and the like. During conventional playtime, children play with toys on a safe space such as a floor or playmat. When playtime has ended, parents or caregivers generally may use storage containers to keep children's toys and games put away so that the floor or playmat is cleared of objects. Examples of such storage containers include boxes, chests, baskets, and the like. These storage containers are often stored in a play area or other room until conventional playtime begins.

Although reasonably adequate, these storage containers are not free of limitations. For example, conventional storage containers are not feasible for on-the-go traveling. It is difficult and inconvenient for parents or caregivers to hold and carry such storage containers on foot. While parents may use a bag or purse to transport toys, however, parents would also need to carry a playmat to provide a safe space for children to play on with their toys. Hence, it would be advantageous to have a backpack that allows a user to store and transport objects and a playmat with great ease.

Accordingly, it is an object of the present invention to provide a backpack that addresses the limitations discussed above.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
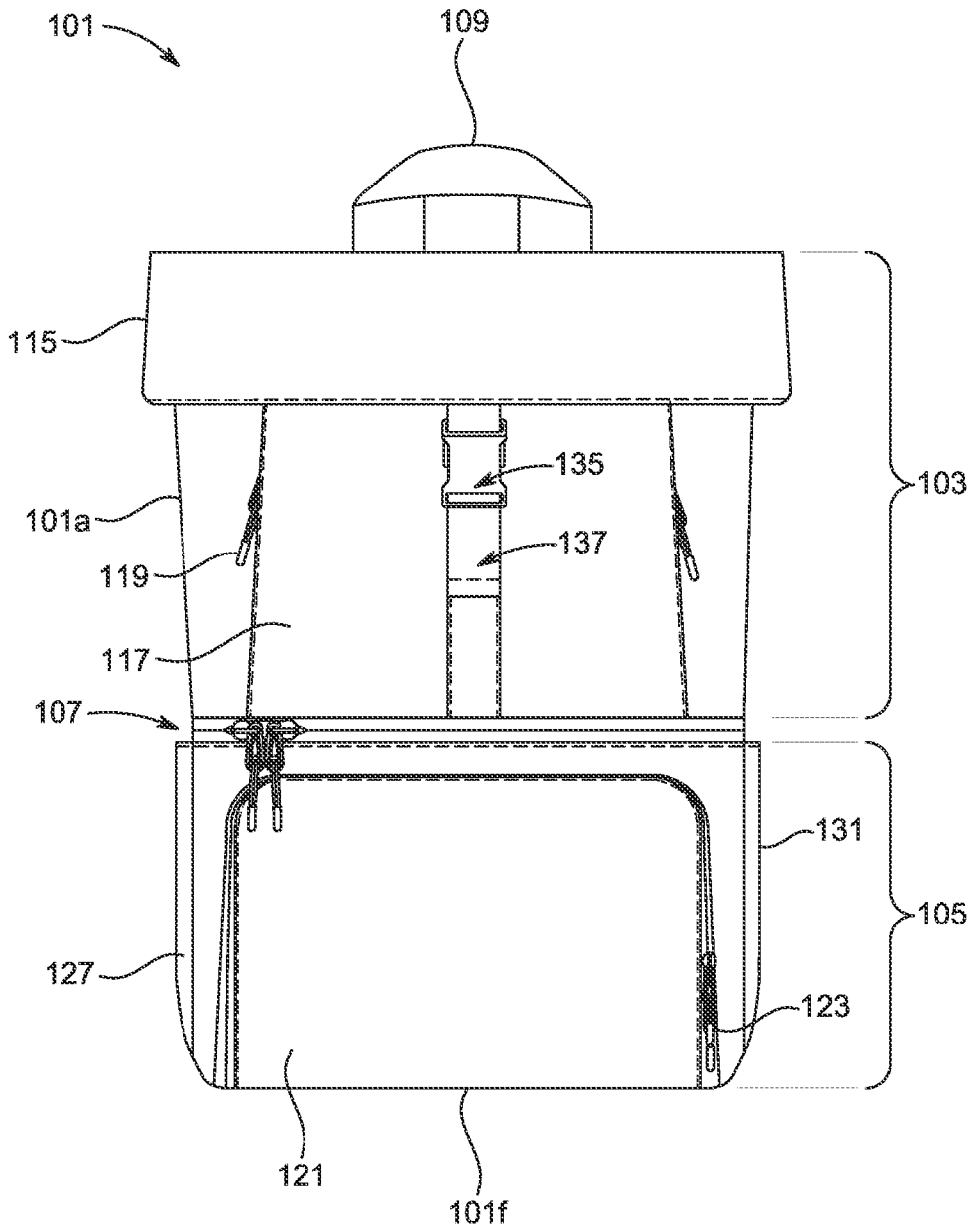
FIG. 1 is a front view of a backpack in a closed configuration in accordance with a preferred embodiment of the present invention.
Figure 2:
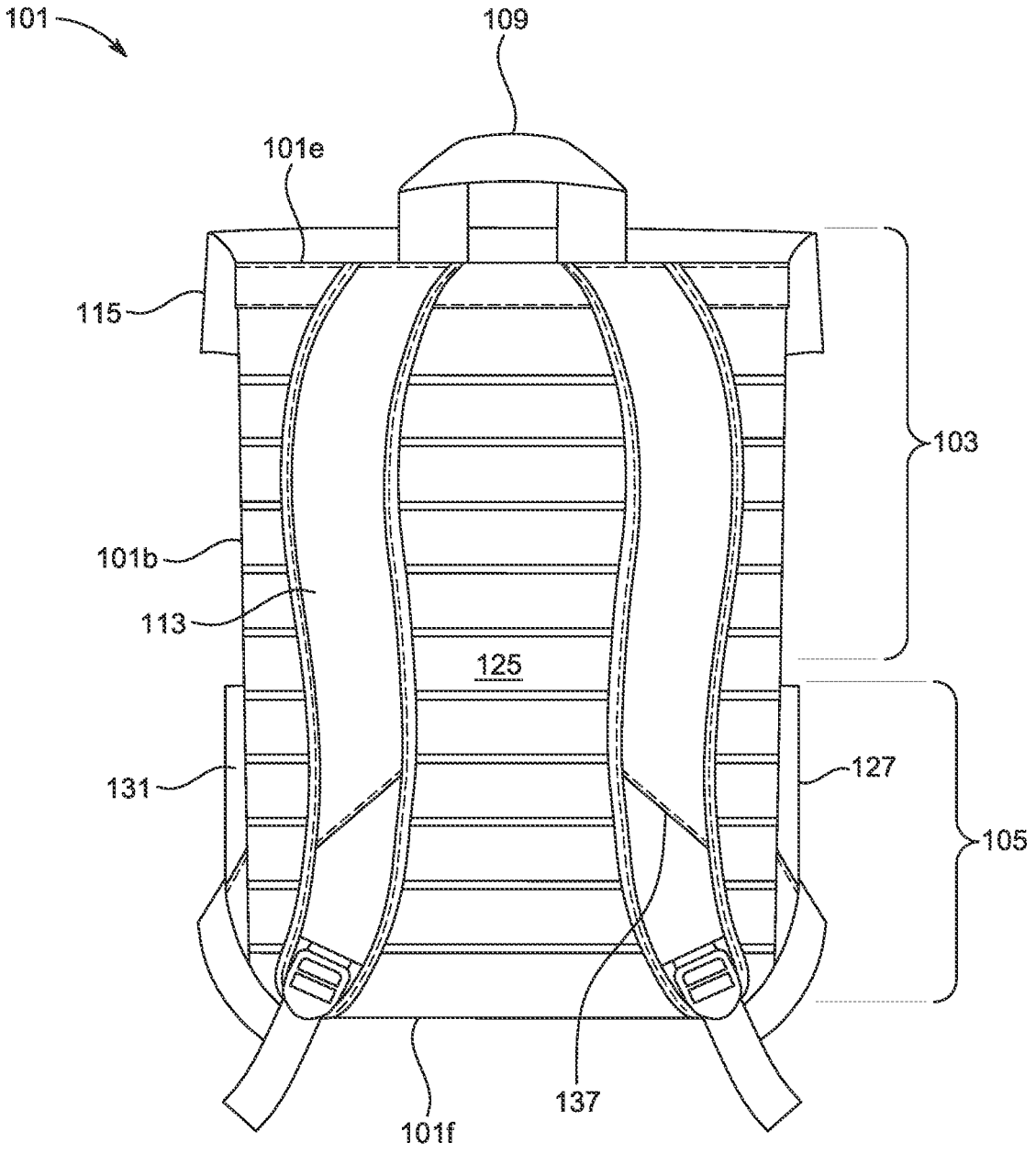
FIG. 2 is a rear view of the backpack of FIG. 1.
Figure 3:
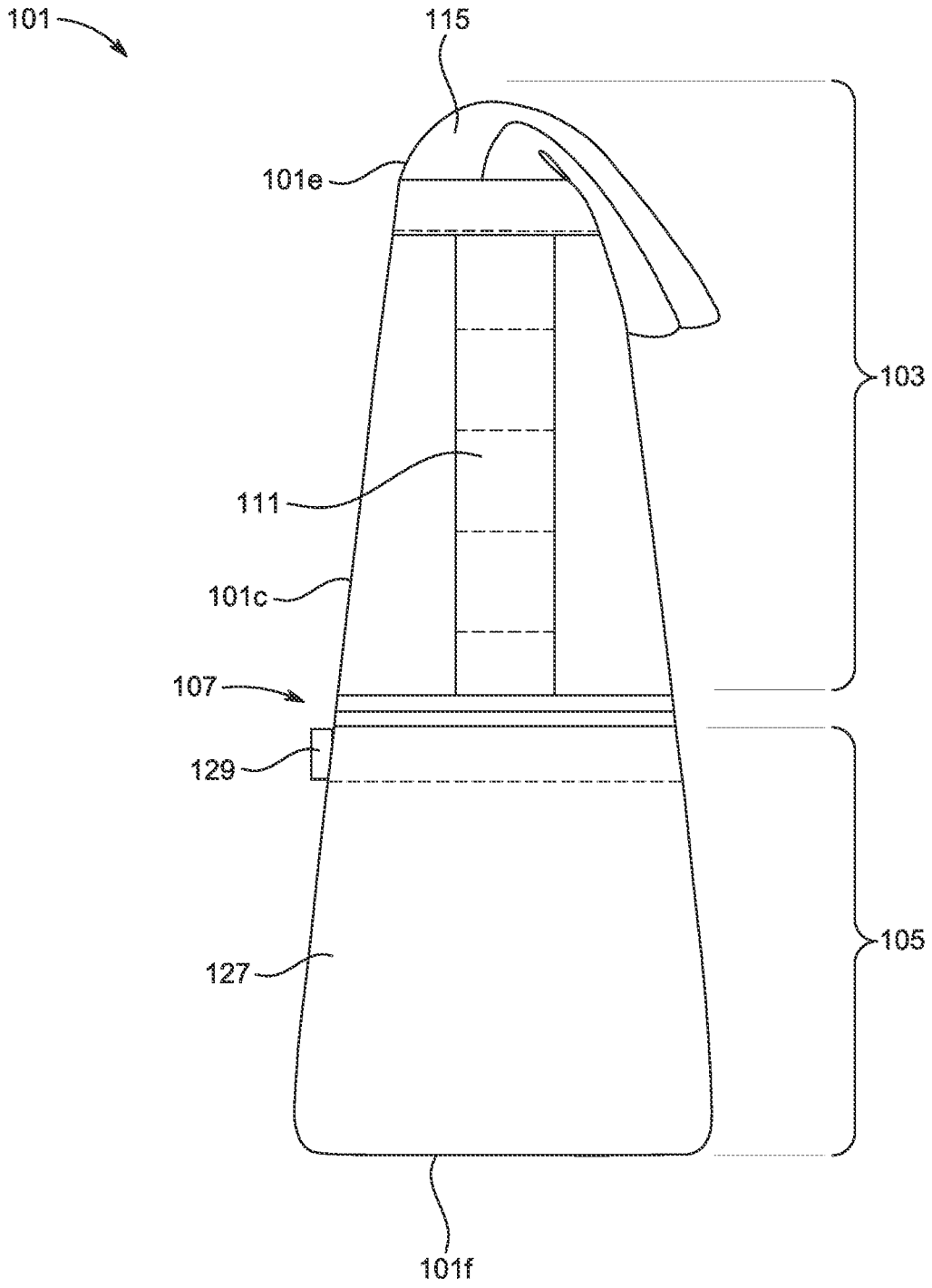
FIG. 3 is a left profile view of the backpack of FIG. 1.
Figure 4:
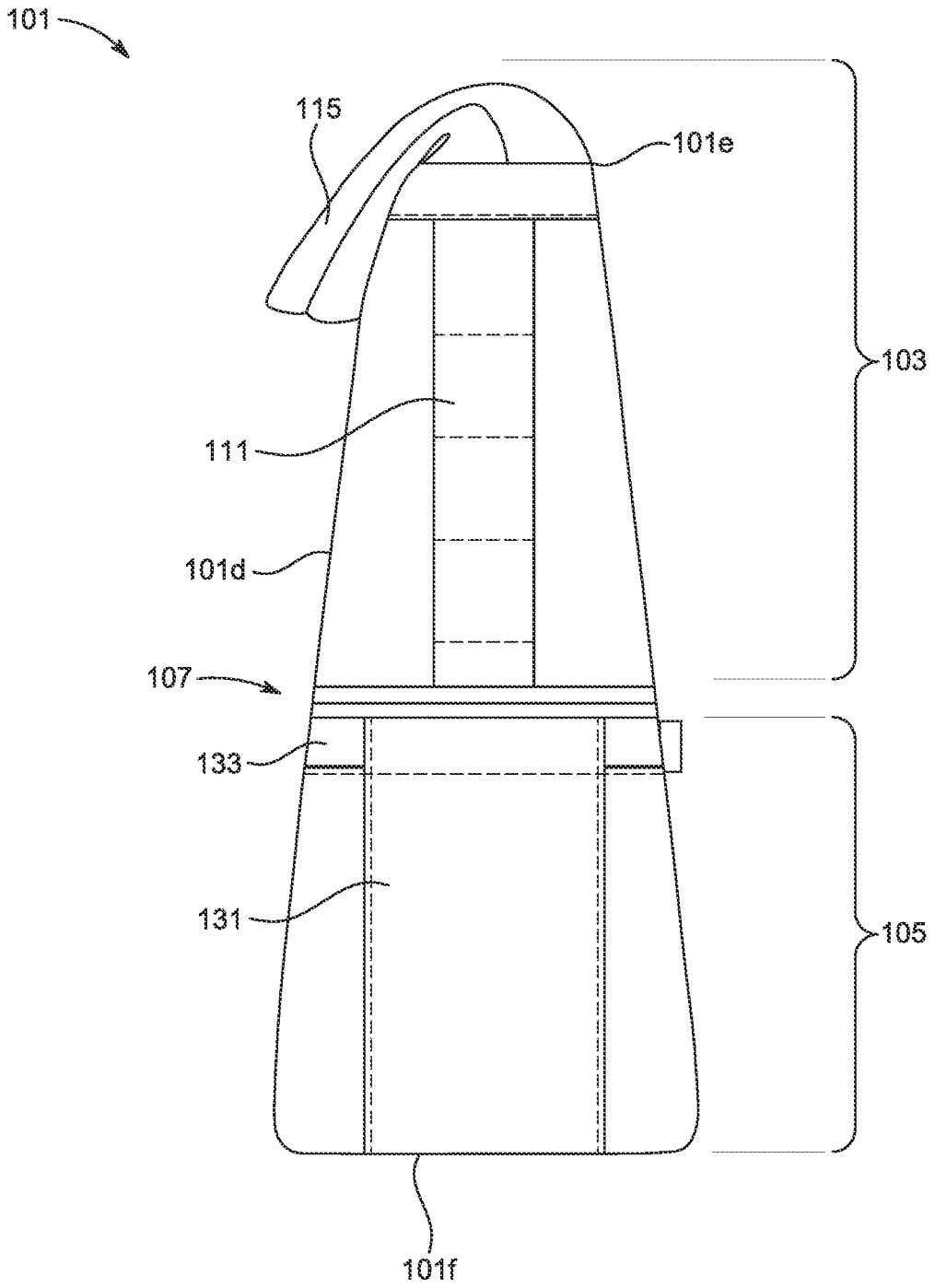
FIG. 4 is a right profile view of the backpack of FIG. 1.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional storage containers. Specifically, the present invention provides a backpack for carrying various objects and a playmat for on-the-go travel with great ease. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1 through 4 depict various views of a backpack 101 in accordance with a preferred embodiment of the present application. It will be appreciated that the backpack 101 overcomes one or more of the above-listed problems commonly associated with conventional storage containers.

In the contemplated embodiment, the backpack 101 includes a backpack body having a front side 101*a*, backside 101*b*, first lateral side 101*c*, second lateral side 101*d*, top side 101*e*, and bottom side 101*f*. The backpack 101 also includes a top compartment 103 and a bottom compartment 105, wherein the top and bottom compartments 103, 105 are separated by one or more closing mechanisms 107 (e.g., preferably zippers with zipper pullers). In the preferred embodiment, the bottom compartment 105 is used to store one or more objects such as children's toys, games, and the like.

In addition, the backpack 101 includes a top handle 109, a pair of lateral modular lightweight load-carrying equipment (MOLLE) loops 111, a pair of adjustable shoulder straps 113, and a foldable flap 115. It should be noted that the flap 115 is shown in a closed configuration. The shoulder straps 113 may include reflective piping 137 for improved aesthetics and safety for the user.

The front side 101*a* includes a first front pocket 117 having one or more closing mechanisms 119 (e.g., zippers with zipper pullers) and a second front pocket 121 having one or more closing mechanisms 123 (e.g., zippers with zipper pullers). The first front pocket 117 is positioned on the top compartment 103 and the second front pocket 121 is positioned on the bottom compartment 105.

The back side 101*b* includes mesh padding 125 (e.g., foam) for breathability. The first lateral side 101*c* includes a hidden elastic side pocket 127 having a hidden gusset 129 for expandable capacity. The second lateral side 101*d* includes a nonhidden elastic side pocket 131 having a hidden gusset 133 for expandable capacity.

The backpack 101 includes a snap buckle 135 having an adjustable strap 137. The snap buckle 135 enables secured closure of the flap 115 to the front pocket 117.

It should be appreciated that the backpack 101 may include an internal frame or structure within the back side 101*b* for allowing the backpack 101 to sit upright when in use.

Figure 5:
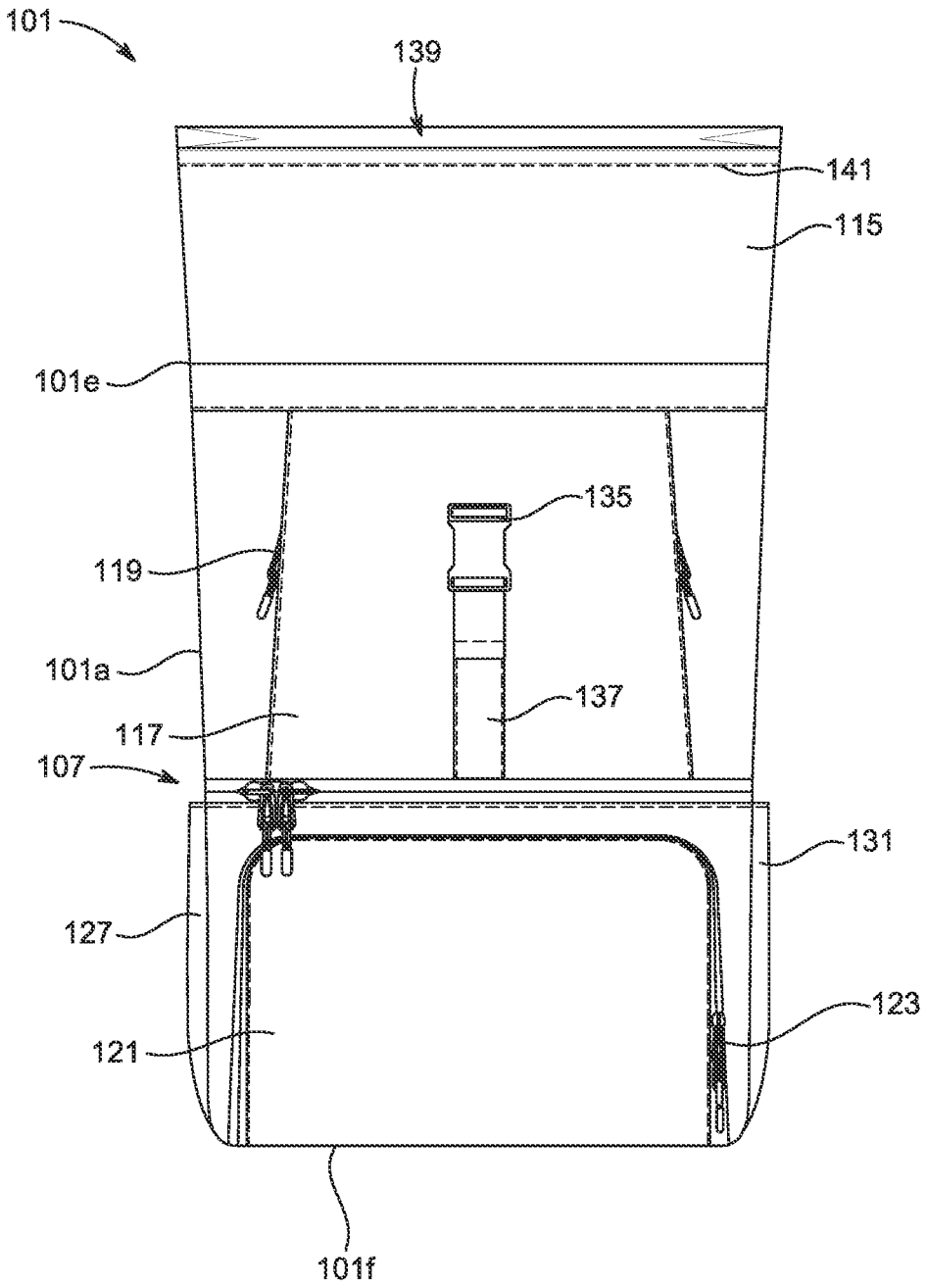
FIG. 5 is a front view of the backpack of FIG. 1, illustrating the flap in an open configuration.
Figure 6:
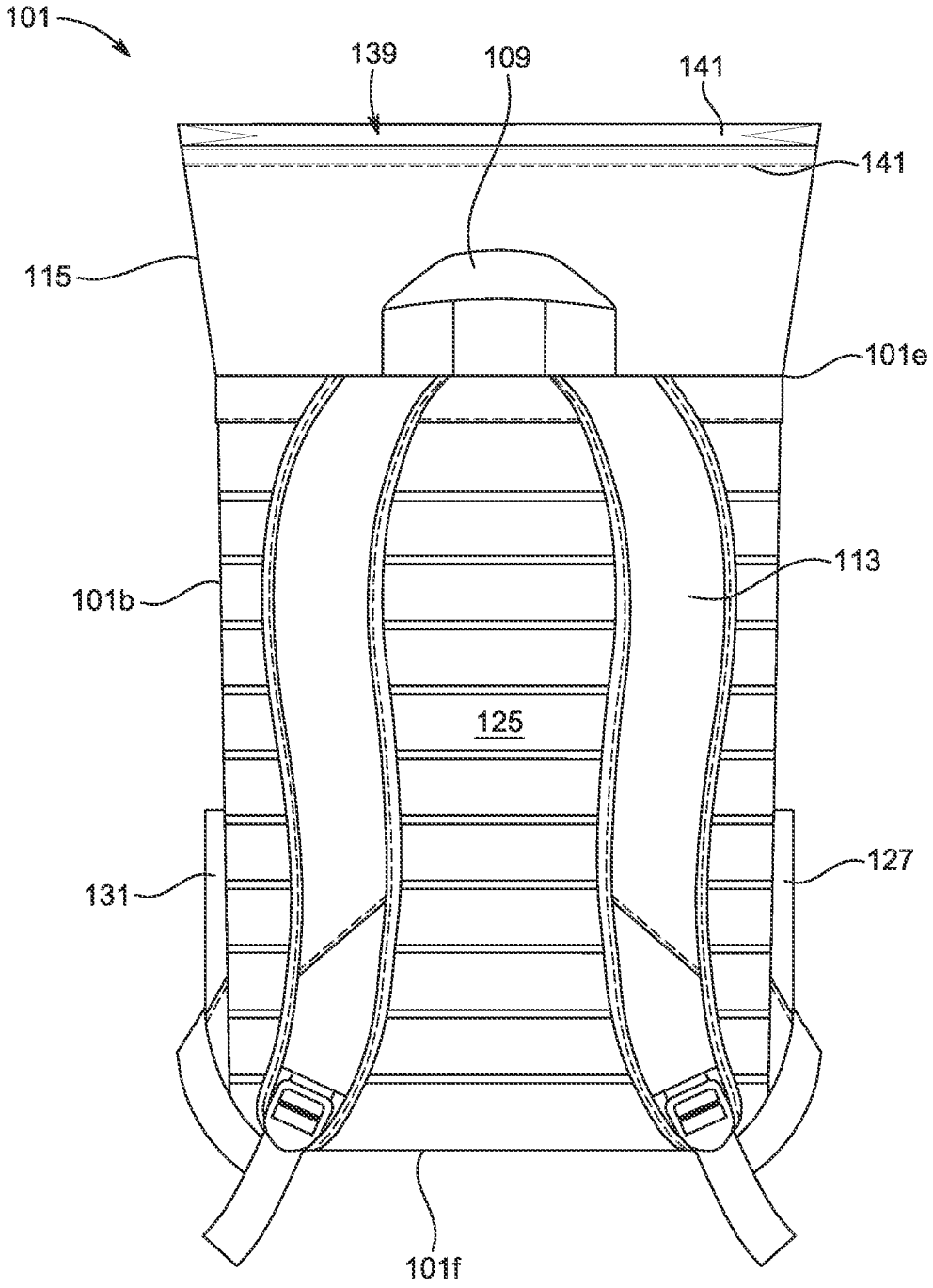
FIG. 6 is a rear view of the backpack of FIG. 1, illustrating the flap in an open configuration.

In FIGS. 5 and 6, front and rear views of the backpack 101 are illustrated, showing the flap 115 in an open configuration. As shown, the front flap 115 includes an interior cavity 139 that a user may use to store one or more objects therein. The flap 115 also includes a magnetic closure 141 within a top portion of the flap 115 for providing secure storage of objects within the interior cavity 139.

Figure 7A:
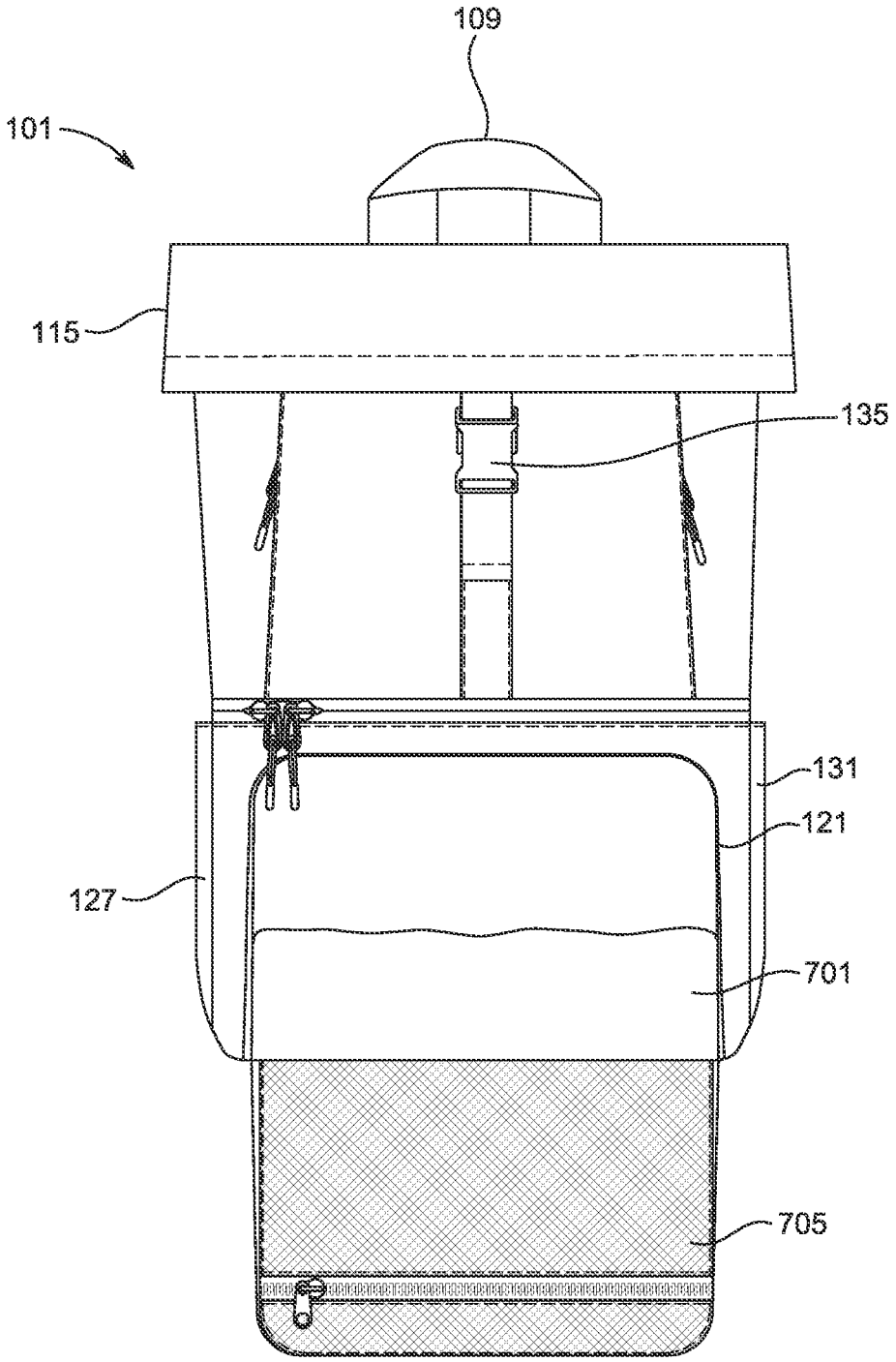
FIG. 7A is a front view of the backpack of FIG. 1, illustrating the second front pocket in an open configuration and a playmat rolled up within the interior bottom compartment.
Figure 7B:
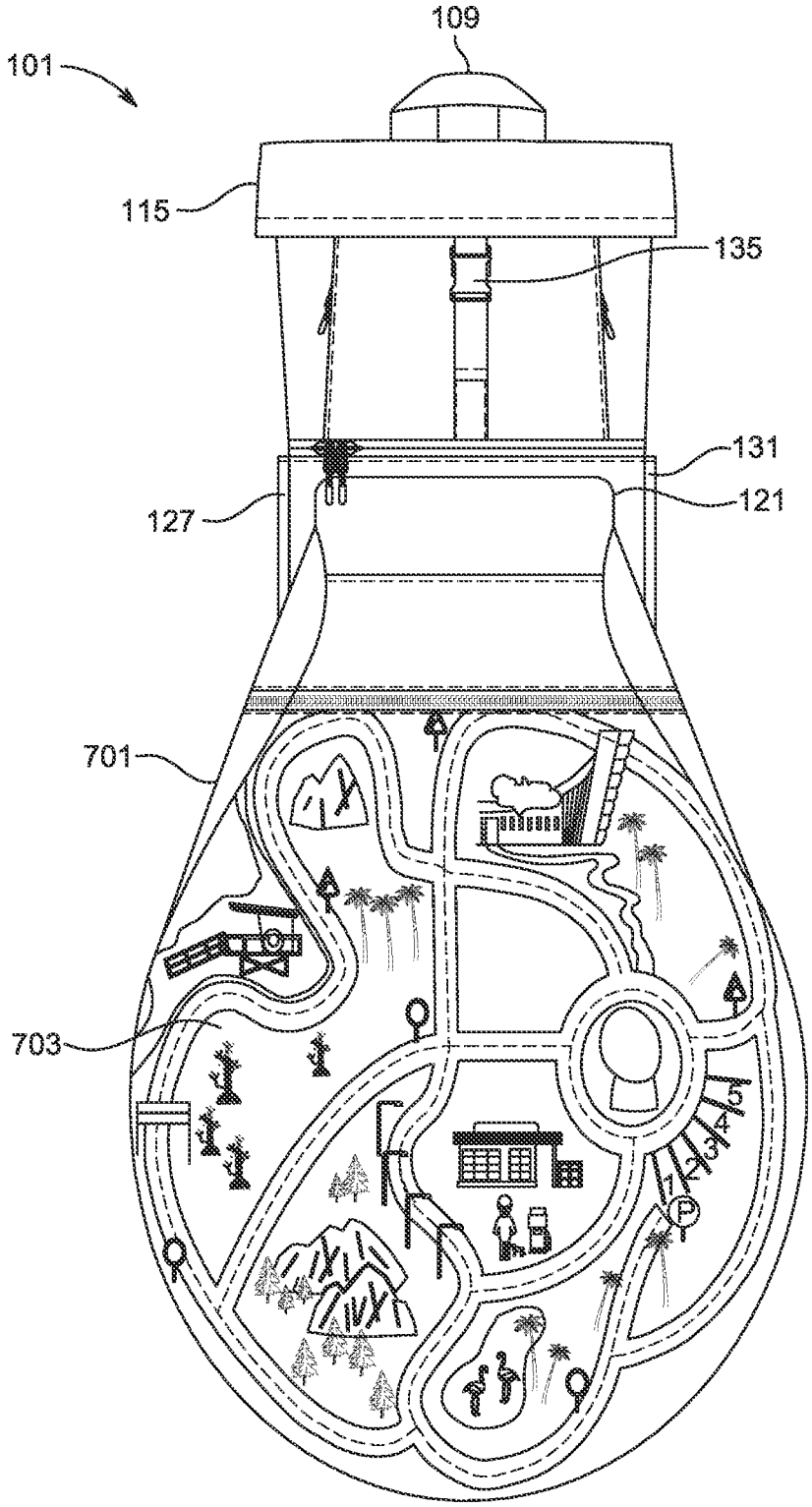
FIG. 7B is a front view of the backpack of FIG. 7A, illustrating the playmat extending outward from the interior bottom compartment.

In FIGS. 7A and 7B, front views of the backpack 101 are depicted. The backpack 101 also includes a playmat 701 that is removable (see FIG. 8). As shown, the playmat 701 can extend outward from the second front pocket 121. The playmat 701 may include indicia 703 such as patterns, themes, colors, images, characters, and other decorative features based on user preference. The second front pocket 121 may include additional compartments such as a mesh pocket 705 with a closing mechanism 707 (e.g., zipper) as illustrated.

Figure 8:
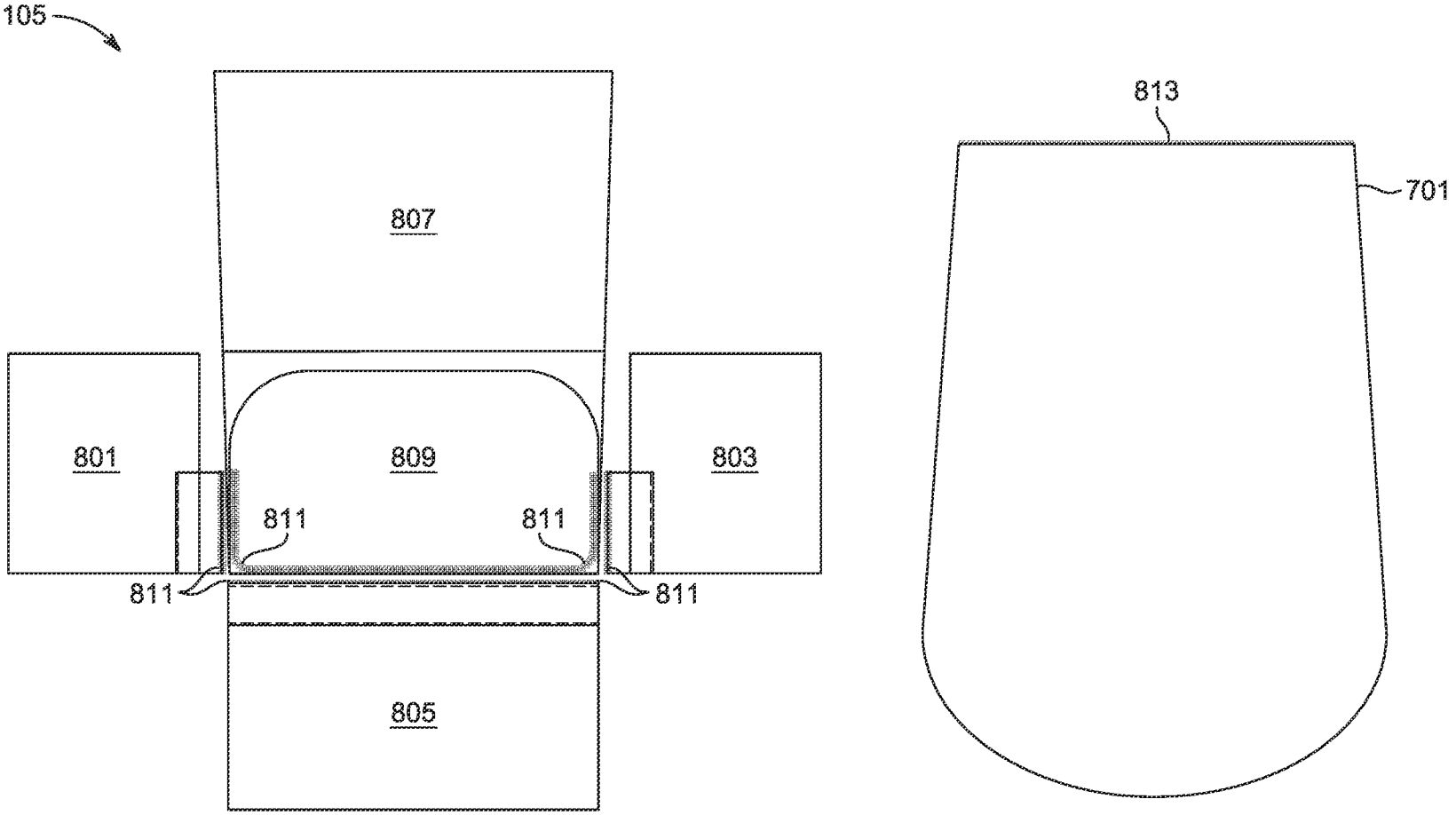
FIG. 8 is a top plan view of the bottom compartment of backpack of FIG. 1, illustrating the playmat detached therefrom.

In FIG. 8, a top plan view of the bottom compartment 105 and the playmat 701 are illustrated. As shown, the bottom compartment 105 includes a left interior side wall 801, a right interior side wall 803, front interior wall 805, a rear interior wall 807, and a bottom interior wall 809. Walls 801-805 and 809 include an attachment mechanism 811 (e.g., preferably a zipper). The playmat 701 includes an attachment mechanism 813 (e.g., preferably a zipper) that removably engages with the attachment mechanism 811.

During use, a user may detach the playmat 701 from the bottom compartment 105 and use the playmat 701 as a surface area for playtime. When playtime is over, the user may reattach the playmat to the closing mechanism 811. Any items used during playtime such as toys, games, and the like can be easily pushed back into the bottom compartment 105 via the playmat 701 or placed on top of the playmat 701 and slid into the bottom compartment 105.

It should be appreciated that the playmat 701 can be interchanged with other playmats having the same configuration based on user preferred aesthetics.

It should also be appreciated that the bottom compartment 105 may be constructed with rigid material to allow the backpack 101 to sit upright.

It should also be appreciated that one of the unique features believed characteristic of the present application is the engagement of the playmat 107 with the bottom compartment 105 for easy and prompt storage.

Figure 9:
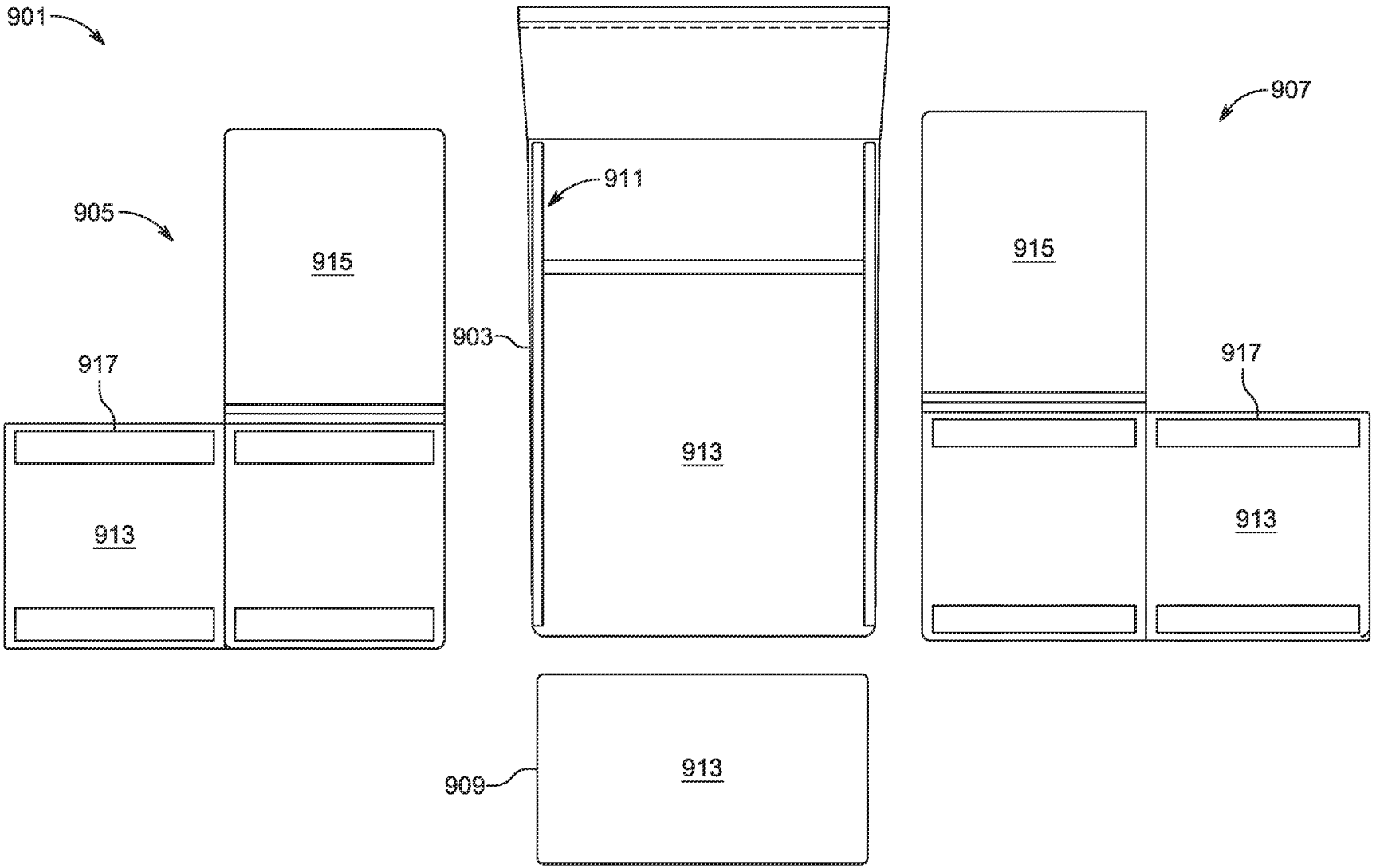
FIG. 9 is a top plan view an interior structure of the backpack of FIG. 1.

In FIG. 9, a top plan view of an interior structure 901 of the backpack 101 is illustrated. It should be noted that the interior structure 901 is contained within lining material to provide a cohesive and aesthetical appearance.

As shown, the interior structure 901 includes a back wall 903, a first lateral sidewall 905, a second lateral sidewall 907, and a bottom 909. The back wall 903 extends from the bottom side 101*f* to the flap 115. The back wall 903 includes a frame 911 extending the length of the backside 101*b*. In the preferred embodiment, the frame 905 comprises of fiber glass rods that are sewn into corners behind the liner. The back wall 903 also includes rigid filler 913 that is preferably a single unitary piece extending the length of the backside 101*b*.

The lateral sidewalls 905, 907 also include rigid filler 913, foam filler 915, and hook-and-loop attachments 917 (e.g., Velcror®). The bottom 909 also includes a unitary piece of rigid filler 913.

Figure 10:
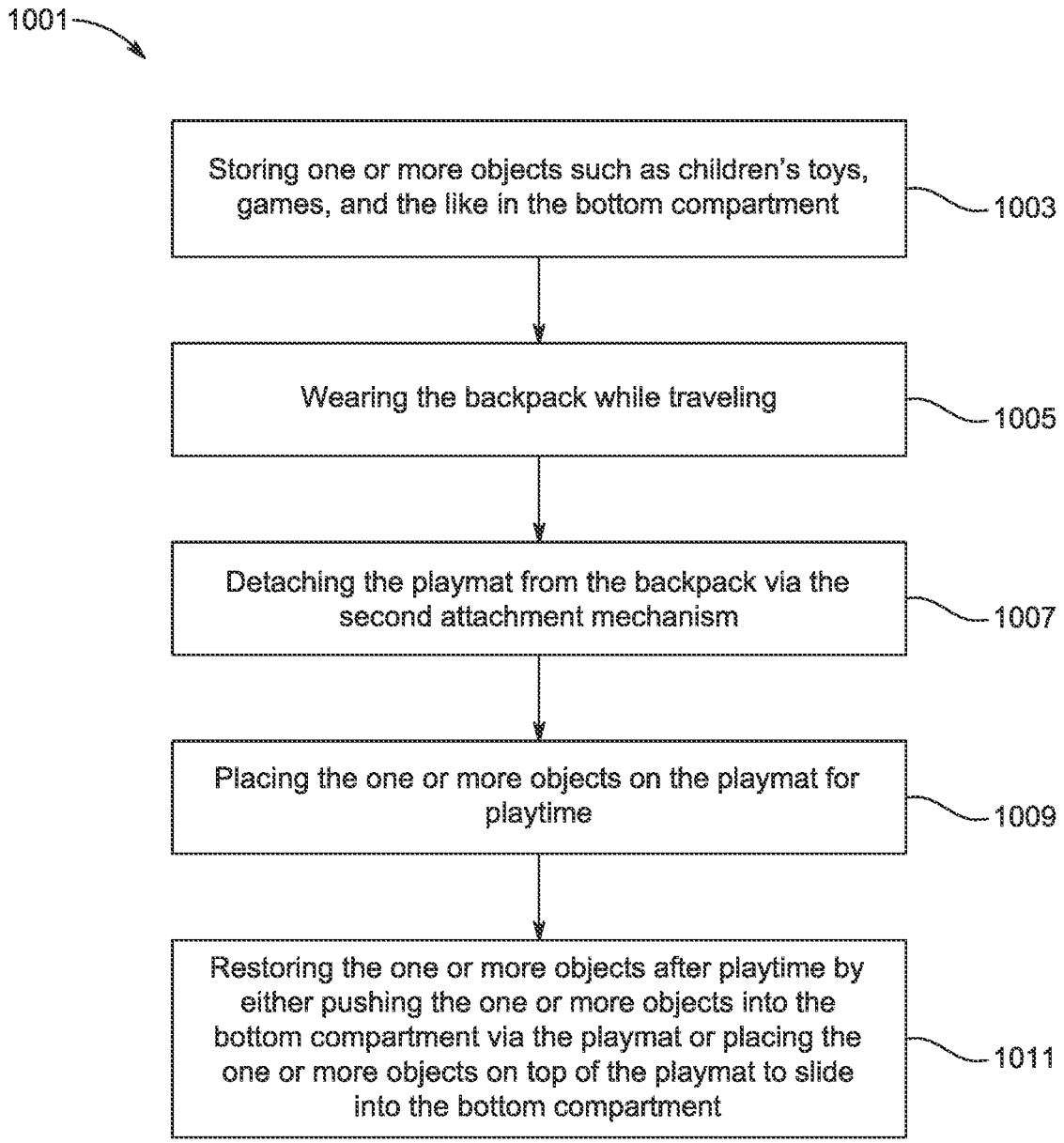
FIG. 10 is a flowchart of a method of use of the backpack of FIG. 1.

In FIG. 10, a flowchart 1001 depicts a method of use associated with the backpack 101. During use, the user can store one or more objects such as children's toys, games, and the like in the bottom compartment, as shown with box 1003. The user can wear the backpack while traveling, as shown with box 1005. The user can detach the playmat from the backpack via the second attachment mechanism and place the one or more objects on the playmat for playtime, as shown with boxes 1007, 1009. The user can then restore the one or more objects within the bottom compartment after playtime by either be easily pushed back into the bottom compartment via the playmat or placed on top of the playmat and slid into the bottom compartment, as shown with box 1011.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A backpack for storing and transporting toys, comprising:

a backpack body having a front side, a back side, a first lateral side, a second lateral side, a top side, and bottom side;

a top compartment having:

a foldable flap extending therefrom, the flap having an interior cavity for storing one or more objects therein, and a magnetic closure for secure storage of the one or more objects;

a bottom compartment having:

interior side walls; and a first attachment mechanism;

a playmat having indicia thereon, the playmat having:

a second attachment mechanism for removably engaging with the first attachment mechanism;

a first front pocket having one or more closing mechanisms, the first front pocket positioned on the top compartment;

a second front pocket having one or more closing mechanisms, the second front pocket positioned on the bottom compartment;

a first lateral side pocket having a hidden elastic closing mechanism;

a second lateral side pocket having an exposed elastic closing mechanism;

a snap buckle configured to secure the flap to the first front pocket;

a pair of shoulder straps;

a pair of lateral modular lightweight load-carrying equipment loops; and a top handle;

wherein the top compartment and the bottom compartment are separated by one or more closing mechanisms.

2. The backpack of claim 1, wherein the one or more closing mechanisms of the first and second front pockets are zippers, the zippers including zipper pullers.

3. The backpack of claim 1, wherein the first and second attachment mechanisms are zippers, the zippers including zipper pullers.

4. The backpack of claim 1, further comprising:

an interior structure, the interior structure having:

a back wall having a frame extending a length of the back side, and a unitary piece of rigid filler;

a first lateral sidewall having rigid filler, foam filler, and hook-and-loop fasteners;

a second lateral sidewall having rigid filler, foam filler, and hook-and-loop fasteners; and a bottom having a unitary piece of rigid filler.

5. The backpack of claim 4, wherein the frame comprises of fiber glass rods.

6. A method for storing and transporting objects quickly during travel, the method comprising:

providing a backpack, the backpack comprising:

a backpack body having a front side, a back side, a first lateral side, a second lateral side, a top side, and bottom side;

a top compartment having:

a foldable flap extending therefrom, the flap having an interior cavity for storing one or more objects therein, and a magnetic closure for secure storage of the one or more objects;

a bottom compartment having:

interior side walls; and a first attachment mechanism;

a playmat having indicia thereon, the playmat having:

a second attachment mechanism for removably engaging with the first attachment mechanism;

a first front pocket having one or more closing mechanisms, the first front pocket positioned on the top compartment;

a second front pocket having one or more closing mechanisms, the second front pocket positioned on the bottom compartment;

a first lateral side pocket having a hidden elastic closing mechanism;

a second lateral side pocket having an exposed elastic closing mechanism;

a snap buckle configured to secure the flap to the first front pocket;

a pair of shoulder straps;

a pair of lateral modular lightweight load-carrying equipment loops; and a top handle;

wherein the top compartment and the bottom compartment are separated by one or more closing mechanisms;

storing one or more objects in the bottom compartment;

wearing the backpack while traveling;

detaching the playmat from the backpack via the second attachment mechanism;

restoring the one or more objects by either pushing the one or more objects into the bottom compartment via the playmat or placing the one or more objects on top of the playmat to slide into the bottom compartment.

* * * * *